US006938595B2

(12) United States Patent
Baek

(10) Patent No.: US 6,938,595 B2
(45) Date of Patent: Sep. 6, 2005

(54) ENGINE CYLINDER HEAD COVER AND ASSEMBLY METHOD THEREOF

(75) Inventor: Hong-Kil Baek, Seoul (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 10/670,884

(22) Filed: Sep. 24, 2003

(65) Prior Publication Data

US 2004/0055555 A1 Mar. 25, 2004

(30) Foreign Application Priority Data

Sep. 25, 2002 (KR) ..... 10-2002-0058170
Jul. 25, 2003 (KR) ..... 10-2003-0051388

(51) Int. Cl.[7] ..... F01M 9/10

(52) U.S. Cl. ..... 123/90.38; 123/195 C; 123/198 E

(58) Field of Search ..... 123/90.38, 195 C, 123/198 E

(56) References Cited

U.S. PATENT DOCUMENTS 3,776,299 A * 12/1973 Rusk et al. ..... 164/385
6,257,188 B1 * 7/2001 Fujii et al. ..... 123/90.38

FOREIGN PATENT DOCUMENTS

JP 06173758 A * 6/1994 ..... F02F/7/00

* cited by examiner

*Primary Examiner*—Thomas Denion
*Assistant Examiner*—Zelalem Eshete
(74) *Attorney, Agent, or Firm*—Morgan Lewis & Bockius LLP

(57) ABSTRACT

An engine cylinder head cover and assembly method thereof is disclosed to constantly maintain the arrangement of a cylinder head cover in relation to a cylinder head by a simple operation, whereby locking bolts for fastening the cylinder head cover onto the cylinder head can be quickly and effectively assembled, thereby improving ease of assembly of the engine.

5 Claims, 4 Drawing Sheets

ENGINE CYLINDER HEAD COVER AND ASSEMBLY METHOD THEREOF

CROSS-REFERENCE TO RELATED APPLICATIONS

This application claims priority of Korean Application Nos. 2002-58170, filed on Sep. 25, 2002, and 2003-51388, filed Jul. 25, 2003, the disclosures of which are incorporated fully herein by reference.

FIELD OF THE INVENTION

The present invention relates to an engine cylinder head cover and an assembly method thereof and, more particularly, to a technique for facilitating the assembly of the engine cylinder head cover.

BACKGROUND OF THE INVENTION

A cylinder head cover generally made of a plastic material, in comparison with a metallic cylinder head, is fastened onto a cylinder head by using a plurality of locking bolts.

The plastic cylinder head cover is advantageous both in reducing weight of the engine and in improving ease of manufacture of the cylinder head cover. However, there is a drawback in that rigidity of holes for coupling the locking bolts is inadequate and the processing accuracy is relatively low.

Accordingly, in order to attain a sufficient rigidity for holes formed at the plastic cylinder head cover, bushings made of steel are inserted into the cylinder head cover to be fastened with the locking bolts.

SUMMARY OF THE INVENTION

Embodiments of the present invention maintain a constant arrangement of a cylinder head cover in relation to a cylinder head by a simple operation. The present invention also provides a fast and effective assembling operation of locking bolts for installing a cylinder head cover on a cylinder head, thereby facilitating the assembly of an engine.

In accordance with one embodiment of the present invention, an engine cylinder head cover comprises a round bushing whose inner circular diameter closely attaches to the shank of the locking bolts, and a long hollow bushing having an oval-shaped pipe hole. The inner flat edge of the oval-shaped pipe hole closely attaches to the shank of the locking bolts, wherein the length of the inner flat edge of the oval-shaped pipe hole is longer than the shank's diameter of the locking bolts.

In accordance with another embodiment of the present invention, an engine cylinder head cover comprises two or more long hollow bushings, each having an oval-shaped pipe hole whose inner flat edge closely attaches to the shank of the locking bolts, wherein the length of the flat edge of the oval-shaped pipe hole is longer than the outer diameter of the shank of the locking bolts.

According to the present invention, there is also provided an assembly method of an engine cylinder head cover. A round bushing is initially assembled for provisionally inserting locking bolts into the cylinder head via a round bushing. The round bushing, which has an inner diameter for tight insertion of the shank of the locking bolts, is disposed at the cylinder head cover. Next, a long hollow bushing is assembled for provisionally fastening the locking bolts into the cylinder head via the long hollow bushing. The flat edge of the oval-shaped pipe hole then closely attaches to the shank of the locking bolts, wherein the length of the inner flat edge of the oval-shaped pipe hole is longer than the shank's diameter of the locking bolts. The locking bolts are then fastened at a fully tightening torque, wherein some of the locking bolts are assembled at the cylinder head via a plurality of assembling bushings, which are placed at the cylinder head cover and has larger inner diameters than that of the shank of the locking bolts, while other locking bolts are provisionally assembled at the cylinder head via the round bushing and the long hollow bushing.

BRIEF DESCRIPTION OF THE DRAWINGS

For fuller understanding of the nature and objects of the present invention, reference should be made to the following detailed description taken in conjunction with the accompanying drawings in which.

DETAILED DESCRIPTION OF THE INVENTION

Hereinafter, an embodiment of the present invention will be described in detail with reference to the accompanying drawings.

Figure 1:
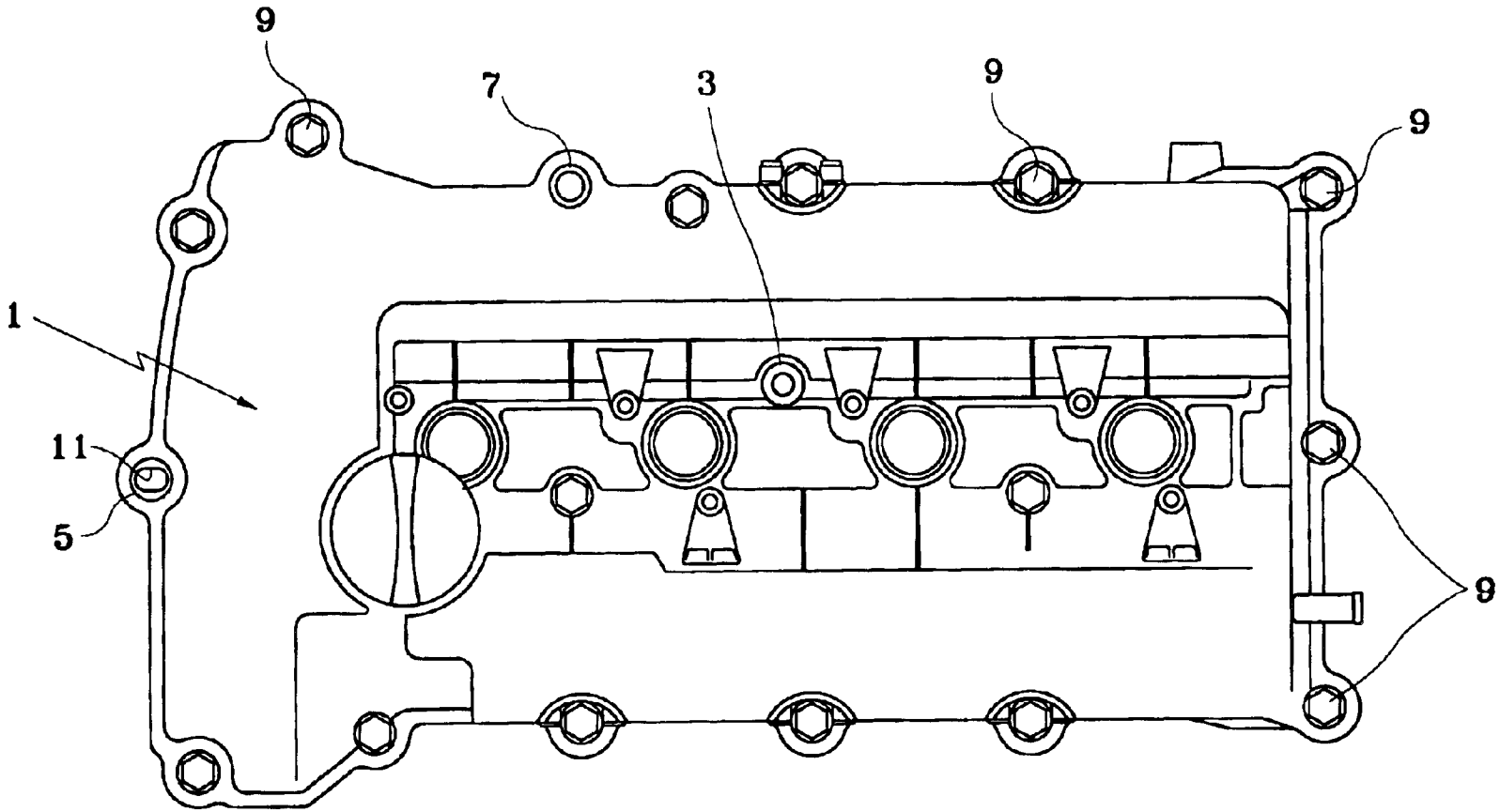
FIG. 1 is a plan view illustrating a cylinder head cover of an engine according to a first embodiment of the present invention.
Figure 2:
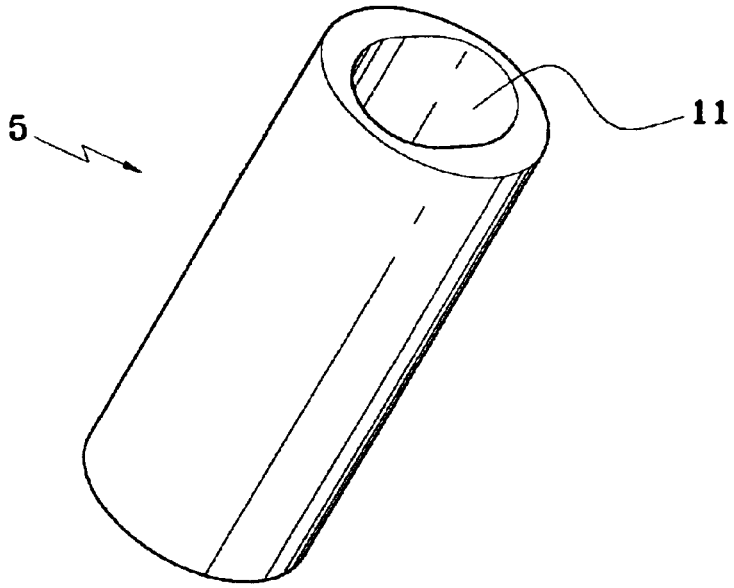
FIG. 2 is an outer view illustrating a long hollow bushing of FIG. 1.

As illustrated in FIG. 1, a cylinder head cover 1 includes a round bushing 3, a long hollow bushing 5, and assembling bushings 7. The round bushing 3 is formed at a central portion of the cylinder head cover 1 and has an inner diameter for tight insertion of the shank of locking bolts 9.

The long hollow bushing 5 is formed with an oval-shaped pipe hole 11 whose inner flat edge tightly fits the shank of the locking bolts 9, wherein the length of the flat edge is longer than the shank's diameter of the locking bolts 9. The oval-shaped pipe hole 11, of which its inner flat edge is parallel to the longitudinal direction of the cylinder head cover 1, is formed at an outer portion of the cylinder head cover 1 in the longitudinal direction.

The oval-shaped pipe hole 11 of the long hollow bushing 5 is formed for absorbing any deformation or manufacturing defects of the cylinder head cover 1 in relation to the cylinder head.

When the inner flat edge of the oval-shaped pipe hole 11 according to the embodiment of the present invention is installed parallel to the longitudinal direction of the cylinder head cover 1, the deformation and manufacturing defects generated in the plastic cylinder head cover 1 can be easily absorbed via the oval-shaped pipe hole 11. Thus, the locking bolts 9 are simply fastened into the bolt holes of the cylinder head through the oval-shaped pipe hole 11.

A plurality of assembling bushings 7 are formed at the cylinder head cover 1 for installing the long hollow bushing 5, round bushing 3 and cylinder head cover 1 onto the cylinder head.

Each of the assembling bushings 7 is formed with a hole, which has a diameter larger than that of the shank of the locking bolts 9 but smaller than that of the head of the locking bolts 9, for absorbing any manufacturing defects of the cylinder head cover 1 and the cylinder head.

The holes of the assembling bushings 7 have a relatively larger diameter than that of the shank of the locking bolts 9, thereby allowing the locking bolts 9 to properly fit into the bolt holes of the cylinder head even in case of possible manufacturing defects of the cylinder head cover 1. The hole is preferably formed with a size that can absorb any manufacturing defects and to have enough area for contacting with the head of the locking bolts 9.

Figure 4:
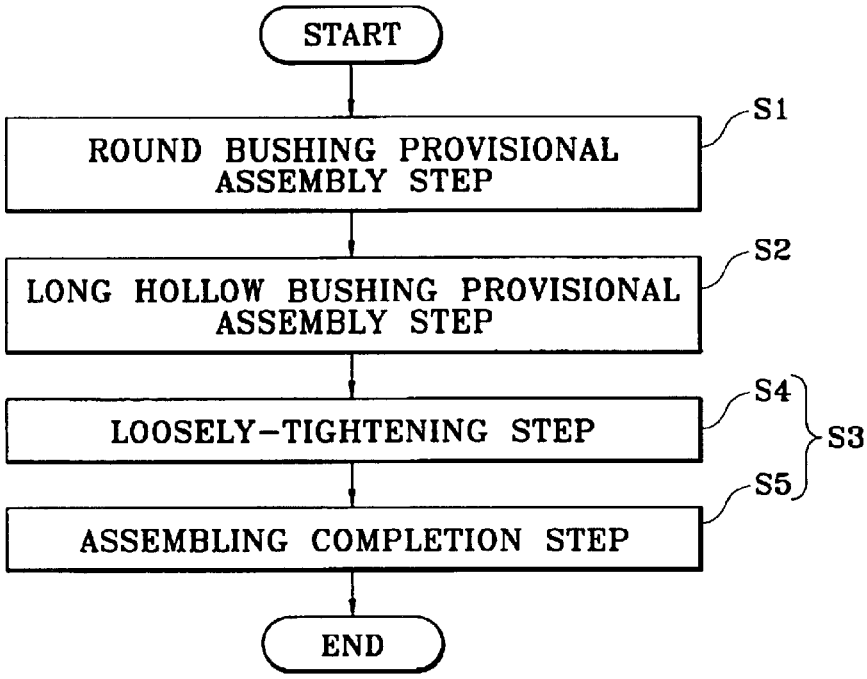
FIG. 4 is a flowchart describing an assembly method of an engine cylinder head cover according to an embodiment of the present invention.

With reference to FIG. 4, the assembly method of the engine cylinder head cover 1 is described below.

According to an assembly method as shown in FIG. 4, a round bushing is provisionally assembled for forming the locking bolts 9 onto the cylinder head via the round bushing 3. The round bushing 3 is installed at the cylinder head cover 1 and has an inner circular diameter for closely attaching to the shank of the locking bolts 9 (see S1). Next, a long hollow bushing is provisionally assembled for forming the locking bolts at the cylinder head via the long hollow bushing 5 having an oval-shaped pipe hole 11, which is placed at the cylinder head cover 1 and whose inner flat edge closely attaches to the shank of the locking bolts 9, wherein the length of the flat edge is longer than the shank diameter of the locking bolts 9 (see S2). Finally, locking bolts are assembled for fastening the locking bolts 9 at a fully tightening torque. Some of the locking bolts 9 are assembled at the cylinder head via a plurality of assembling bushings 7, which are placed at the cylinder head cover 1. Each assembling bushing 7 has a larger inner diameter than the shank's diameter of the locking bolts 9, while the other locking bolts 9 are provisionally assembled at the cylinder head via the round bushing 3 and the long hollow bushing 5 (see S3).

The round bushing provisional assembly step S1 and the long hollow bushing provisional assembly step S2 according to the present invention are manually performed. An operator, therefore, can permanently fix the location and arrangement of the cylinder head cover 1 in relation to the cylinder head via the round bushing provisional assembly step S1 and the long hollow bushing provisional assembly step S2. Alternatively, the round bushing provisional assembly step S1 and the long hollow bushing provisional assembly step S2 may be executed by an automatic mechanism.

The round bushing provisional assembly step S1 is completed by provisionally assembling the locking bolts 9 onto the cylinder head via the round bushing 3 disposed at a central part of the cylinder head cover 1. The long hollow bushing provisional assembly step S2 is completed by provisionally assembling the locking bolts 9 on the cylinder head via a long hollow bushing 5 having an oval-shaped pipe hole 11 at one edge of the cylinder head cover 1 in the longitudinal direction, wherein the inner flat edge of the oval-shaped pipe hole 11 is parallel with the longitudinal direction of the cylinder head cover 1.

Following the completion of the round bushing provisional assembly step S1, the cylinder head cover 1 in relation to the cylinder head can be maneuvered freely along the axial direction of the locking bolt of the round bushing provisionally assembled via the round bushing 3. Then, when the long hollow bushing provisional assembly step S2 is completed, the maneuverability of the cylinder head cover 1 is restricted along the axial direction, so that the disposition and arrangement of the cylinder head cover 1 in relation to the cylinder head can be constantly fixed.

Accordingly, in the following locking bolts assembly step S3, even if any vibration or impact is transmitted to the engine during the assembly, the locking bolts 9 can be easily fastened, thereby facilitating the assembly of the engine cylinder head cover.

The locking bolts assembly step S3 according to the embodiment of the present invention is executed by an automatic bolt tightening device, which simultaneously couples a plurality of locking bolts 9, greatly shortening the assembling time. However, the locking bolts assembly step S3 can be also manually performed.

The locking bolts assembly step S3, as shown in FIG. 4, comprises a loosely-tightening step S4 and an assembling completion step S5. In the loosely-tightening step S4, the locking bolts 9 are assembled via the loosely-tightening torque, which is larger than the provisional assembly tightening torque used for provisionally assembling the locking bolts 9 through the round bushing 3 and the long hollow bushing 5, but smaller than the fully tightening torque.

On the other hand, in the assembly completion step S5, the locking bolts 9 are re-tightened as the fully tightening torque after executing the loosely-tightening step S4.

The provisional assembly tightening torque is a torque required for constantly maintaining the disposition and arrangement of the cylinder head cover 1 in relation to the cylinder head while the locking bolts 9 are coupled to the assembling bushings 7. The value of the provisional assembly tightening torque is preferably smaller than the loosely-tightening torque.

The fully tightening torque, which is larger than the value of the loosely-tightening torque, is required for completely installing the cylinder head cover 1 onto the cylinder head.

The disposition and arrangement of the cylinder head cover 1 in relation to the cylinder head are constantly maintained by manually performing the round bushing provisional assembly step S1 and the long hollow bushing provisional assembly step S2. Then, all locking bolts 9 necessary for the assembling operation of the cylinder head cover 1 through the loosely-tightening step S4 and the assembling completion step S5 using an automatic bolt tightening apparatus are coupled at the same time, allowing to rapidly and easily finish the assembling operation of the cylinder head cover 1.

Figure 3:
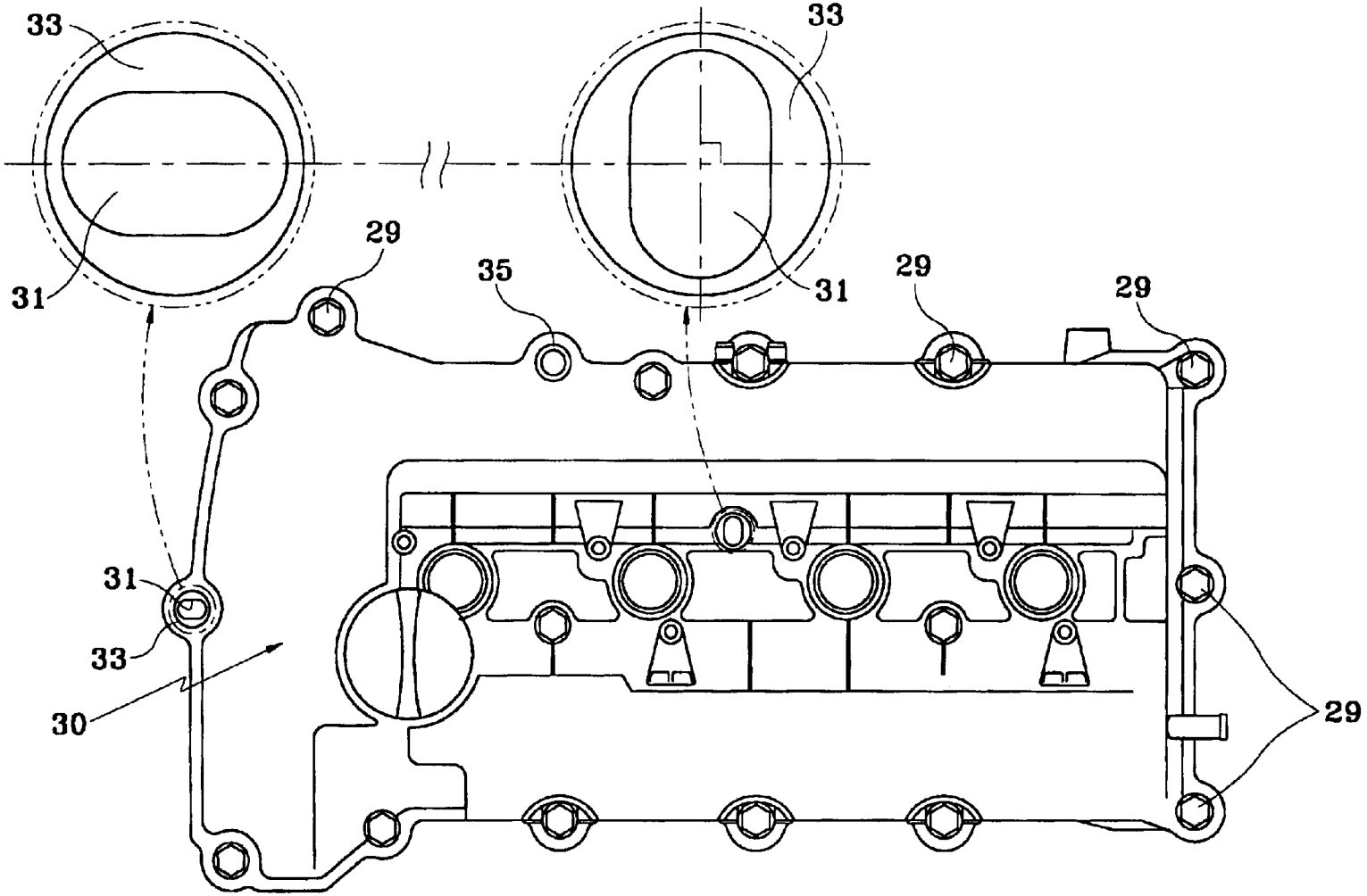
FIG. 3 illustrates a second embodiment of the present invention.

On the other hand, FIG. 3 illustrates another embodiment of an engine cylinder head cover. FIG. 3 discloses a cylinder head cover 30 having two or more long hollow bushings 33 each having an oval-shaped pipe hole 31, whose inner flat edge closely adheres to the shank of the locking bolts 29, wherein the length of the flat edge is longer than the outer diameter of the shank of the locking bolts 29.

There are two long hollow bushings 33 disposed at the cylinder head cover 30, wherein the flat edges of each oval-shape pipe hole 31 are perpendicularly installed each other.

In order to fasten the two long hollow bushings 33 and the cylinder head cover 30 onto the cylinder head, a plurality of assembling bushings 35 are formed at the cylinder head cover 30 for insertion of the locking bolts 29.

The assembling bushings 35 are designed to absorb deformation and manufacturing defects of the cylinder head cover 30 in relation to the cylinder head by forming a hole having a diameter larger than that of the shank of the locking bolts 29 but smaller than that of the head, as described in the first embodiment.

The assembly method of the engine cylinder head cover 30 thus described can be applied in almost the same method as the first embodiment. The only difference is that, in the assembly method thus described, step S1 is substituted with a step for provisionally assembling the locking bolts 29 using any one of two long hollow bushing 33. The remaining steps can be initially applied to the assembly method thus described as in the first embodiment.

As apparent from the foregoing, there is an advantage in the engine cylinder head cover and assembly method thereof according to the present invention in that the disposition and arrangement of a cylinder head cover in relation to a cylinder head can be constantly maintained by a simplified assembly method. There is also another advantage in that the locking bolts for installing a cylinder head cover onto a cylinder head are assembled more quickly and effectively, thereby contributing to an improved assembly of an engine.

What is claimed is:

1. An engine cylinder head cover comprising:

a round bushing that is attachable to a shank of at least one locking bolt and having a circular inner diameter; and a long hollow bushing having an oval-shaped pipe hole with an inner flat edge having a length and attachable to the shank of said at least one locking bolt, wherein the length of the flat edge is longer than a diameter of said shank, wherein said round bushing is mounted at the central portion of the cylinder head cover; and said long hollow bushing is mounted at the outer side of the cylinder head cover.

2. The engine cylinder head cover according to claim 1, wherein said round bushing is mounted at a central portion of the cylinder head cover; and said long hollow bushing having an oval-shaped pipe hole whose inner flat edge is parallel to the longitudinal direction of the cylinder head cover and is formed at one external side of the cylinder head cover in a longitudinal direction.

3. The engine cylinder head cover according to claim 1, wherein a plurality of assembling bushings are mounted at the cylinder head cover for insertion of said locking bolts for installing said long hollow bushing, said round bushing and the cylinder head cover onto the cylinder head; and said assembling bushings are designed to absorb any manufacturing defects of the cylinder head cover in relation to the cylinder head by forming a hole having a diameter larger than that of the shank of said locking bolts but smaller than that of the head of said locking bolts.

4. The engine cylinder head cover according to the present invention, comprising two or more long hollow bushings each having an oval-shaped pipe hole, whose inner flat edge closely attaches to the shank of locking bolts, wherein the length of the inner flat edge is longer than the external diameter of the shank of said locking bolts, wherein the flat edges of the oval-shaped pipe holes of said two long hollow bushings are perpendicularly installed in relation to each other.

5. The engine cylinder head cover according to claim 4, wherein a plurality of assembling bushings are mounted at the cylinder head cover to allow insertion of said locking bolts for installing said long hollow bushing and the cylinder head cover onto the cylinder head; and assembling bushings are designed to absorb any manufacturing defects of the cylinder head cover in relation to the cylinder head by forming a hole having a diameter larger than that of the shank of said locking bolts but smaller than that of the head of said locking bolts.

* * * * *